US005698814A

United States Patent [19]

Parsons et al.

[11] Patent Number: 5,698,814

[45] Date of Patent: Dec. 16, 1997

[54] HARD TARGET PENETRATOR WITH MULTI-SEGMENTING CASING CUTTER

[75] Inventors: Gary H. Parsons, Niceville; Joseph Gregory Glenn, Fort Walton Beach, both of Fla.

[73] Assignee: The United States of America as represented by the Secretary of the Air Force, Washington, D.C.

[21] Appl. No.: 583,887

[22] Filed: Jan. 11, 1996

Related U.S. Application Data

[63] Continuation-in-part of Ser. No. 409,559, Mar. 10, 1995, abandoned.

[51] Int. Cl.[6] ..... F42B 12/20

[52] U.S. Cl. ..... 102/478; 102/307; 102/382; 102/473; 102/479; 89/1.14; 89/1.15; 175/4.6

[58] Field of Search ..... 102/306–310, 102/378, 382, 389, 473, 476, 478, 479, 489, 705, 393, 396, 397; 89/1.14, 1.15; 175/4.6

[56] References Cited

U.S. PATENT DOCUMENTS

| | | | |
|---|---|---|---|
| H344 | 10/1987 | Williamsen et al. | 102/476 |
| 905,042 | 11/1908 | Wratzke | 102/478 |
| 1,146,484 | 7/1915 | Dunwoody | 102/478 |
| 3,053,182 | 9/1962 | Christopher | 175/4.6 |
| 3,108,540 | 10/1963 | Fletcher | 102/378 |
| 3,233,688 | 2/1966 | Bell | 102/307 |
| 3,244,104 | 4/1966 | Mills et al. | 102/378 |
| 3,245,485 | 4/1966 | Bell | 102/307 |
| 4,354,433 | 10/1982 | Owen | 102/307 |
| 4,638,130 | 1/1987 | Grossler et al. | 200/61.45 |
| 4,649,824 | 3/1987 | Guay | 102/307 |
| 5,010,823 | 4/1991 | Morrison | 102/307 |
| 5,255,608 | 10/1993 | Min et al. | 102/215 |

FOREIGN PATENT DOCUMENTS

| | | | |
|---|---|---|---|
| 3408113 | 5/1985 | Germany | 102/478 |
| 3934041 | 5/1993 | Germany | 102/478 |

*Primary Examiner*—Harold J. Tudor

*Attorney, Agent, or Firm*—Gerald B. Hollins; Thomas L. Kundert

[57] ABSTRACT

A penetrating bomb weapon comprising a long hollow cylinder constructed of high strength steel or similar material and including a pointed nose to aid in penetration of media such as concrete, soil, steel or a hardened surface. The cylinder contains an insensitive explosive that is separated into segments by shock attenuating materials so that one segment of the cylinder may detonate without detonating or destroying adjacent segments. The number of segments may be two or more depending on the complexity of the target to be attacked. Initiation of the main charge within each segment is achieved using explosive boosters positioned so that shocks transferred to adjacent segments, and the initiation train of these segments, is minimized. Separation of the segments is accomplished using explosive cutter charges which perforate and/or spall through the case wall of the penetrator bomb.

16 Claims, 3 Drawing Sheets

HARD TARGET PENETRATOR WITH MULTI-SEGMENTING CASING CUTTER

This application is a Continuation In Part of application Ser. No. 08/409,559 filed Mar. 10, 1995, now abandoned, in the name of the same inventors and of common assignment herewith.

RIGHTS OF THE GOVERNMENT

The invention described herein may be manufactured and used by or for the Government of the United States for all governmental purposes without the payment of any royalty.

BACKGROUND OF THE INVENTION

The present invention relates generally to a multi-segment hard target penetrator bomb.

The current method of defeating layered or partitioned targets is to employ multiple strikes using penetration warheads against the target. A bomb known as the BLU-109 (2000 pound penetrator bomb) is typical of the warheads now used in this application. The BLU-109 provides more than adequate damage to a single room or layer within a target; however damage to adjacent target layers, layers protected by a modest thickness of reinforced concrete, is minimal with this device. Complicated fuzing techniques which sense voids within the target can improve this performance by optimizing the point at which warhead detonation occurs however damage to layers above and below the point of detonation is yet minimal. As shown by the present invention, improvements in fuzing can be coupled to a bomb producing more than one explosion, so that the overall lethality of the weapon can be dramatically improved.

The following United States patent documents are of interest.

U.S. Pat. No. 905,042—Wratzke
U.S. Pat. No. 1,146,484—Dunwoody
U.S. Pat. No. 3,108,540—Fletcher
U.S. Pat. No. 3,244,104—Mills et al.
U.S. Pat. No. 4,638,130—Grosslet et al.
U.S. Pat. No. 4,649,824—Guay
U.S. Pat. No. 5,010,823—Morrison
U.S. Pat. No. 5,255,608—Min et al.
U.S. Pat. No. H344—Williamsen et al.

The U.S. Pat. No. 905,042 Wratzke patent discloses an armor piercing projectile in which the explosive material is placed in one or more projectile chambers and is protected from impact detonation by a wood or similar material member located in the nose end of the projectile. The spread of impact forces over large surface areas of the explosive material is said to preclude impact detonation of the explosive material. The Wratzke patent appears to be silent with respect to dividing the projectile into segments and separate in time detonations of these segments.

The U.S. Pat. No. 1,146,484 Dunwoody patent describes an armor piercing shell in which a rear portion of the explosive charge is used to add forward movement to the front part of the shell after impact with a target. The Dunwoody patent contemplates two separate detonation events and removal of a rear portion of the shell to enable first charge detonation-based additional propulsion but does not teach segregation of the explosive material into segments for destroying separate portions of an impacted target.

The U.S. Pat. No. 3,108,540 Fletcher patent describes use of an explosive energized cutter apparatus to segregate the casing of a missile into severed sections. The Fletcher apparatus uses a pair of heavy rigid charge separating plates, a thin disc of explosive material and a shaped band of material such as copper cooperating in a timed sequence of events to sever the missile wall and other longitudinal axis-parallel elements. Notably however, the Fletcher apparatus uses a thin sheet, small quantity of explosive material and this material acts upon the relatively thin and soft wall of a missile.

The U.S. Pat. No. 3,244,104 Mills et al. patent also describes an explosive charge based missile separation device. In the Mills et al. apparatus a shaped charge of explosive is disposed around the periphery of a circular disc received in the missile between missile motors—at the intended point of motor segregation. The Mills et al separation device is especially arranged to use a vee-shaped containment for a relatively small separation explosive charge; to include a separation space between the shaped charge and the interior surface of the missile casing; to use minimal support of the shaped charge and therefore employ insulating material in this support; and to cover the shaped charge of explosive with a "V-shaped liner" fabricated from an unspecified material. The present invention is believed to be distinguished from these arrangements.

The Grossler et al U.S. Pat. No. 4,638,130 patent describes a system for detecting different detonating conditions (post impact warhead locations) for a follow-up charge in a dual stage weapon containing a primary explosive charge and the follow-up explosive charge. Acceleration sensors are used to provide signals to be evaluated for determining the respective detonating condition.

The U.S. Pat. No. 4,649,824 Guay patent describes a missile or aerospace vehicle separation apparatus which employs a linear shaped charge of explosive as an energizing source and disposes this shaped charge in a tunnel using organic materials and a backup ring arrangement around the missile interior. The present invention is believed to be substantially distinguished from these arrangements.

The U.S. Pat. No. 5,010,823 Morrison patent describes a missile segment segregation arrangement in which the explosive charges for accomplishing both serration of the missile casing and for propelling the segregated portions apart are contained in a single shaped charge housing. This combination charge housing, the shaped charges and other details of the Morrison apparatus are believed readily distinguished from applicants' invention.

The Min et al U.S. Pat. No. 5,255,608 patent describes a programmable fuze for an intelligent hard-target weapon for initiating a warhead detonation, the Min, fuze provides a real-time estimation of each one of a plurality of media as the weapon is penetrating through each media.

The U.S. Pat. No. H 344 Williamsen et al. Registration document is concerned with a shaped charge missile warhead which also is provided with a course-altering or canting apparatus for reorienting the missile to a course perpendicular to the surface of a hardened or armored target-immediately prior to target impact. Such reorientation is useful in assisting the missile's warhead to penetrate the armor rather than being harmlessly deflected away by an oblique-angle impact with the armor surface. Segregation of the missile warhead from the missile's main body is an included part of this reorientation and therefore the Williamsen et al. document discloses use of a shaped charge cutting ring to achieve warhead separation. The nature of the Williamsen et al. cutting ring as well as the reason for accomplish the cutting are submitted to distinguish the present invention.

The following German patent documents are also of interest.

Patentschrift DE 3408 113 C1
Offenlegungsschrift DE 39 34041 A 1

The Patentschrift DE 3408 113 C1 document of one Dr. Peter Grossler describes a hard target warhead device in which two separately controllable explosive charges located in physically segregatable parts of a warhead are separated by "a containment structure" and are controlled in detonation to provide a maximum degree of damage to a runway-surface target. The Grossler invention contemplates a delayed or intrusion-responsive detonation of the second explosive charge in order that its ongoing presence be a deterrent to repair or use of the runway after damage from first charge detonation. One embodiment of the Grossler apparatus employs a physically weakened outer case for the warhead, i.e., a FIG. 2 and FIG. 3 illustrated threaded joining of the segregatable sections. Notably however, with the exception of this threaded segregation arrangement, a suggested use of "pyrotechnic elements" of the cutting cord and explosive bolt types and segregation based on an incidental effect of a propellant charge 14, the Grossler patent is somewhat vague with respect to how segregation of the warhead casing is to be achieved. Upon close inspection it moreover appears that the Grossler invention contemplates warhead separation prior to main charge detonation only in the limited instance of a thread-weakened warhead casing; in other instances two detonations from an non-segregated warhead (or single warhead location) are arguably contemplated.

The Offenlegungsschrift DE 39 34041 A 1 document describes a dual explosive charge-based torpedo apparatus in which one charge opens a hole in the side of a targeted ship and the second charge achieves internal damage to the ship structure. In the '404 A 1 apparatus there is also an absence of a casing segregation-achieving apparatus. One embodiment of the invention contemplates separating the two torpedo charges with greater physical distance during the first detonation, as a result of pressure generated by a gas generator 24, however maintenance of an integral relationship between casing segments is contemplated and is in fact necessary to enable the stated goal of the first charge preparing an opening for the second charge.

SUMMARY OF THE INVENTION

An objective of the present invention is to provide improved munition effectiveness by causing munitions explosions to occur at different levels in the target. The invention includes a warhead explosive charge segregating apparatus and is especially intended for use against targets that are layered. Potential targets include buildings, hardened shelters, ships and underground storage facilities.

The invention relates to a munitions weapon or bomb or warhead comprising a long hollow cylinder, a cylinder which may in fact be in excess of ten to twelve feet in length, constructed of high strength steel or similar material and provided with a pointed nose to aid in the penetration of media such as concrete, soil, steel or any hardened surface material. The cylinder contains a mechanical shock-insensitive explosive charge that is separated into segments by separators which contain shock attenuating materials and an explosive cutter charge. The shock attenuating materials are used to prevent premature detonation in the adjacent explosive charge segments during or after the time the cutter charge has separated a segment such as the aft most segment from the parent body of the penetrator bomb or warhead. The number of segments may be two or more depending on the complexity of the target to be attacked. Initiation of the main charge within each segment is preferably accomplished using explosive boosters positioned so that shocks transferred to adjacent segments and the possibility of premature initiation or detonation of these segments is minimized.

An advantage of the invention is that explosive energy is distributed along the trajectory of the warhead as it penetrates the target thus increasing the target damage and the likelihood that critical components will be destroyed. This unique feature is made possible by several improvements in the art including the development of shock-insensitive explosives that withstand the very high shock loads imposed by detonations in adjacent weapon segments.

It is an object of the present invention to provide an improved warhead for use against multiple layered hardened targets.

It is another object of the present invention to provide a hardened target penetrator bomb which includes a metal jet casing segregation apparatus that is effective with a thick hardened steel bomb casing.

It is another object of the present invention to provide a hardened target penetrator bomb which includes a spallation casing segregation apparatus that is effective with a thick hardened steel bomb casing.

Additional objects and features of the invention will be understood from the following description and claims and the accompanying drawings.

These and other objects of the invention are achieved by a multiple explosive charge sequential detonation ballistically launched multiple layered hardened target penetration warhead weapon apparatus comprising the combination of:

a unitary body member having an axially aligned uppermost nose end and subtending lengthwise and downward extending integral elongated hollow thick-walled metal cylinder body portions;

a first warhead charge of low mechanical shock-sensitivity first explosive material received within said subtending lengthwise extending integral elongated hollow metal cylinder body portion;

a second warhead charge of low mechanical shock-sensitivity second explosive material received axially adjacent said first warhead charge within said subtending lengthwise extending integral elongated hollow metal cylinder body portion;

separator means disposed in selected axial location within said subtending elongated metal cylinder hollow body portion and segregating said first and second warhead charges of explosive material into axially separate individually controllable discrete segments;

said separator means including third explosive material charged metal jet-generating cutter means for electively separating said body member integral elongated metal cylinder and said first and second low mechanical shock-sensitivity explosive material charges into lengthwise separated warhead segments subsequent to a warhead ballistic launching event;

said separator means third explosive material charge metal jet generating means comprising an explosive material mass of overall hourglass shape with an upstanding central cylindrical portion that is topped and bottomed by mating diameter conical frustum portions of increasing diameter in respective upward and downward directions, and a similarly shaped laterally-enclosing fusible metallic copper jacket surrounding said explosive material mass;

rigid metallic cylinder canister means surrounding said third explosive material charge and said similarly shaped laterally-enclosing metallic copper jacket, said rigid metallic cylinder canister means being received within said separator means and within said unitary body member for shunting externally sourced deformation forces around said third explosive; material charge and said similarly shaped laterally-enclosing fusible metallic copper jacket.

Figure 1:
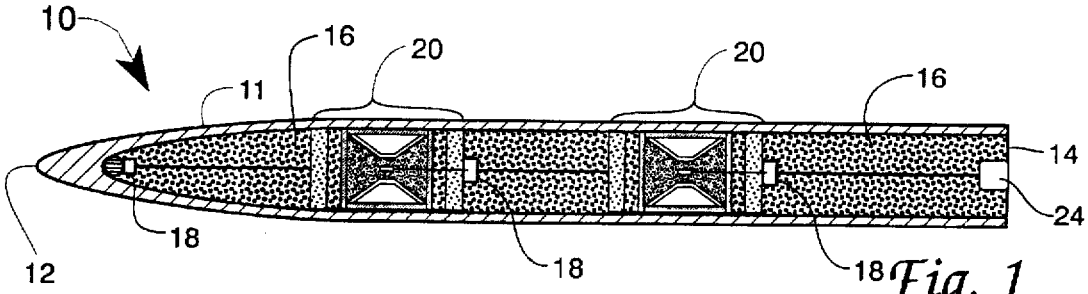
FIG. 1 is a longitudinal sectional diagram of a multi-segment hardened target penetrator bomb, with discrete fuzing in each segment.
Figure 3:
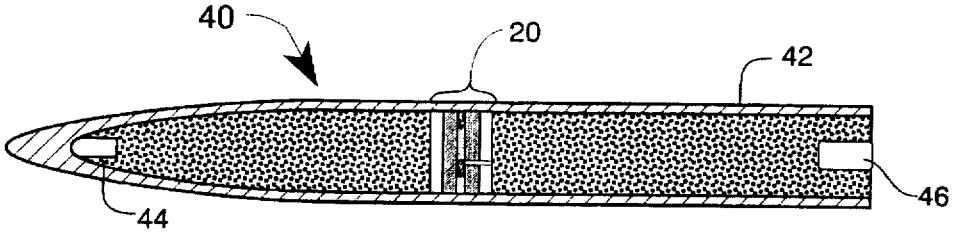
Figure 6:
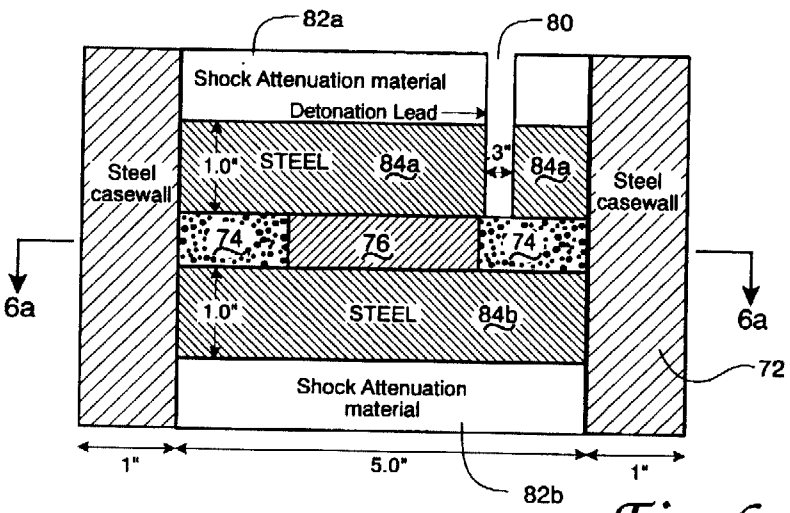
Figure 4:
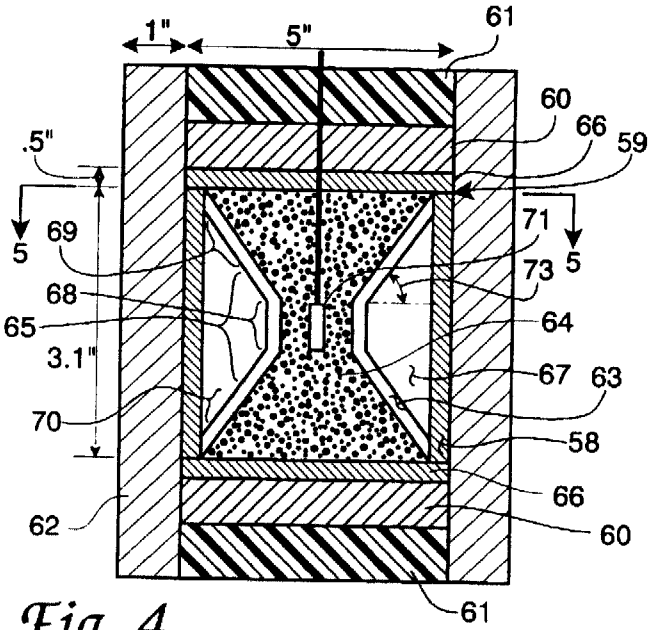
Figure 5:
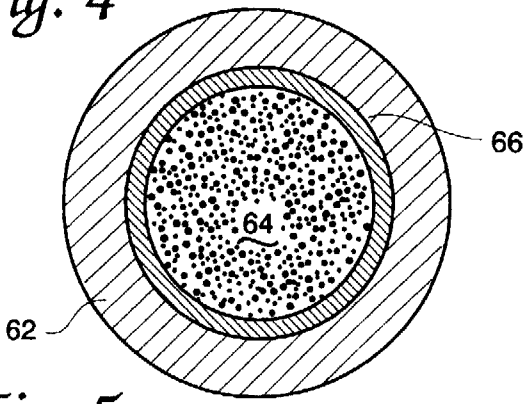
Figure 7:
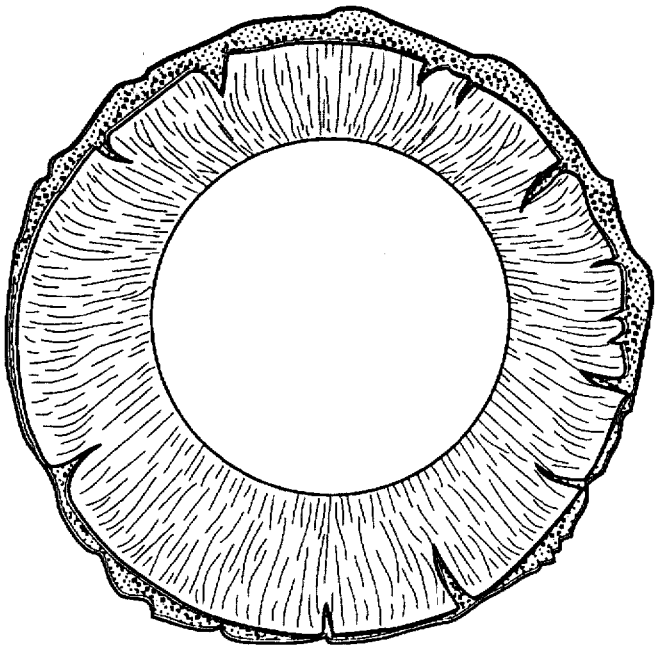
Figure 7A:
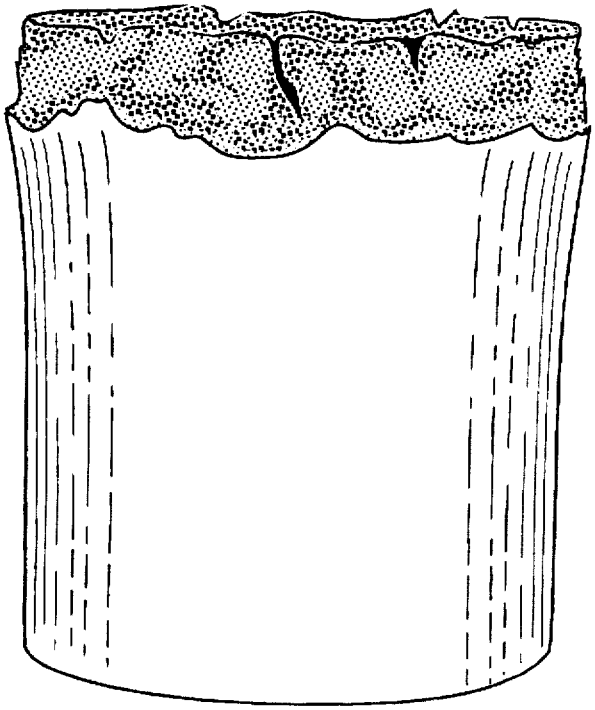

FIGS. *2a*, *2b*, *2c* and *2d* are diagrams of a target being penetrated by a three-segment hard target penetrator bomb;

FIG. 3 is a longitudinal sectional diagram of a two-segment penetrator bomb warhead with discrete fuzing in each segment;

FIG. 4 is a sectional view of a cutter/canister used to separate the FIG. 1 or FIG. 3 segments;

FIG. 5 is a cross-sectional view of the FIG. 4 cutter/canister taken along lines 5—5 of FIG. 4;

FIG. 6 is a sectional view of a second type of cutter for separating penetrator bomb segments by spallation;

FIG. *6a* is a cross-sectional view taken along lines *6a*—*6a* of FIG. 6; and FIGS. 7 and *7a* are views from photographs, of one section of a penetrator bomb that has been cut by spallation.

DETAILED DESCRIPTION

As shown in FIG. 1, the multi-segment hardened target penetrator bomb 10 comprises a long hollow cylinder 11 provided with a pointed or ogival nose 12 and an aft or tail closure plate 14. The nose 12 is an aid in the penetration of media such as concrete, soft, steel or any hardened media. The FIG. 1 apparatus is most readily employed as a "bomb" weapon that is dropped from an aircraft however, as is known in the art of munitions devices, similar apparatus can be arranged for use as the warhead of an artillery projectile. Apparatus of this nature is variously referred to herein as a multi-segment hardened target penetrator bomb, a penetration bomb, a warhead, and a ballistically launched warhead weapon.

The FIG. 1 cylinder 11 is preferably constructed of high strength steel or similar material, a steel such as the type 4340M forged steel which is manufactured by National Forge and other suppliers may for example be used in the cylinder 11. The cylinder 11 contains an insensitive explosive 16 that is separated into segments by separator assemblies 20 which include shock attenuating material and a cutting charge apparatus so that one segment of the charge may separate from the remainder of the bomb and detonate without detonating or destroying the adjacent segments. The number of penetration bomb segments may be two or more depending on the complexity of the target to be attacked. A typical insensitive explosive fill for the cylinder 11, the penetrator bomb casing, may contain the material known as AFX-644, a formulation that consists of 30% TNT, 40% NTO, 20% Aluminum and 10% wax.

There are booster units 18 for each FIG. 1 segment, each booster unit includes a pyrotechnic detonator delay element and booster explosive material. Shock attenuating materials used in the FIG. 1 penetration bomb include plastic or ceramic masses with an air gap. The separator assemblies which include these materials are indicated at 20 in the FIG. 1 drawing and also at 20 in FIG. 3 and are disclosed in additional detail below herein. Initiation of the main charge within each FIG. 1 segment is preferably accomplished using explosive boosters positioned so that shock transfer to adjacent segments and the initiation train of these segments is minimized. A typical location for a fuze 24 is shown in FIG. 1 at the aft end of the cylinder 11.

FIGS. 4, 5, 6, *6a*, 7 and *7a* in the drawings are diagrams which contain additional information regarding the portions of the FIG. 1 which are above identified as separator assemblies 20 in the Multi-segment hard target penetrator bomb. As will be apparent from the following discussion each of the FIG. 1 and FIG. 3 separator assemblies 20 includes an explosive charge which is used to cut the casing of the penetrator. Each cutter charge, is designed to cut the FIG. 1 penetrator bomb into physically discrete portions once it is inside or otherwise adjacent a target. It is significant to note that each of these cutter charge arrangements is called upon to achieve a rapid and relatively clean separation of the cylinder 11 into multiple warhead segments and also that this separation is accomplished in a cylinder or bomb casing which is made of hardened steel, steel of the FIG. 1 and FIG. 4—indicated one inch thickness range. This casing construction is for example found to be much more difficult to segregate than is the relatively thin and soft material encountered in the missile casings disclosed in certain of the above referred-to reference patent documents. The cutter charge arrangement of the present invention is also called upon to act against a surface which is curving in nature, i.e., against the concave interior surface of the FIG. 1 and FIG. 3 penetrator bomb. Two cutter charge approaches are described below.

CONICAL CUTTER

The conical cutter charge operates on the principle of producing a 360 degree jet of metal such as copper that cuts the penetrator bomb into lengthwise portions from its inside. The drawings show two views of a conical cutter charge; a sectional view in FIG. 4 and a cross-sectional view in FIG. 5; in both views the penetrator bomb casing 62 is shown. An explosive material 64 is used inside the copper cutter as an energy source charge. One suitable high performance explosive for the FIG. 4—FIG. 5 cutter is known as "Octol", another such explosive is known as "PBXN-110". Octol is made up of 75% HMX and 25% TNT; PBXN-110 is made up of 88% HMX and 12% inert binder.

The drawings show the copper cutter to be received inside a canister 59 which is preferably made of steel. The canister includes the cylindrical wall section 58 and the oppositely disposed end plate members 66 each of which may be made from steel which also of the 4340M type available from National Forge. The preferred thickness for this canister steel in the FIG. 4 cutter is indicated by the dimensions indicated on the left side of the drawing. This canister 59 is of course intended to transfer impact loads so that the cutter charge is not crushed by compression on impact.

The metallic copper of the conical cutter, the copper which is formed into a jet by detonation of the explosive material 64 appears at 63 in the FIG. 4 drawing and is disposed in the form of an explosive material container or an explosive material-surrounding sheath 65 of particular shape and dimensions. The shape and relative dimensions of this container or sheath and of the included explosive material are in fact critical in order to achieve the desired sequence of events and successful warhead segregation when the explosive material 64 is detonated.

The shape shown in FIG. 4 may be described for example as a cylinder 68 that is topped and bottomed by conical frustum sections 69 and 70 or alternately as having an overall hourglass-like configuration. A successful set of dimensions for a cutter usable in the present invention is shown in FIG. 4 of the drawings. The angle indicated at 73 in FIG. 4 is included in this set of dimensions and is preferably made to be an angle of thirty five degrees plus or minus five degrees with respect to the horizontal.

The dimensions shown in FIG. 4 are believed to be scaleable upward or downward over a range of scaling factors between one-half and two i.e., downward by a factor of one-half and upward by a factor of two while maintaining satisfactory performance. With such scaling the illustrated shape of the explosive material 64 charge and its copper or the like container-sheath 65 is maintained however, the quantities of copper metal and explosive material are increased or decreased according to the available volume in the achieved hourglass. The explosive material mass included in the FIG. 4 illustrated conical cutter is preferably in the four hundred forty (440) to four hundred sixty (460) grams of weight range.

During operational detonation of the FIG. 4 cutter, detonation pressures in the range of 390 Kilobars or 5 million pounds per square inch are to be expected. At such pressures the physical strength of the preferred metallic copper of the sheath 65 is negligable and the metal of the sheath behaves somewhat in the nature of a liquid. For present discussion purposes this detonation pressure-deformed metal may be referred to as "compressed metal" and is formed into a moving metal mass jet which acts upon the casing 62 to accomplish casing segregation.

In the operating sequence of the FIG. 4 cutter, upon detonation initiation by an igniter fuze 71, it is desired that the vertically disposed portions of the sheath 65, i.e., the portions 68, attain this compressed metal state first. This event in fact occurs in the course of a few tens of microseconds following detonation initiation in the case of the above indicated explosive materials. The metal of this sheath portion therefore provides an initial part of the moving metal jet which performs the penetrator bomb casing segregation cutting.

Compression of the sheath metal of the conical frustum sections 69 and 70 occurs a few additional tens of microseconds after this first compression and the compressed metal of the section 69 for example is forced downward to add to and fall in behind the initial jet material. Similarly the sheath metal from the section 70 is coincidentally compressed and forced upward to join the jet of moving metal. The generated upward and downward forces from detonation of the respective lower and upper conical frustum shaped explosive material masses tends to maintain the metal of the jet in a thin or effectively sharp cutter layer which severs both the canister wall 58 and the casing 62 in a quick and reliable manner. Shock wave and other transient wave phenomenon of course can alter this intended operating sequence and such effects are especially to be considered in the case of a curved warhead casing.

Segregation of the present invention penetrator bomb into segments is preferably accomplished following initial impact with a target surface. Such segregation supports the target effects illustrated in FIG. 2*a* through FIG. 2*d* of the drawings. It is considered to be within the spirit of the invention however for another sequences of or location of segregation events to be accomplished. It is conceivable for example that actuation of the cutter charge and the casing segregation event may be desirably accomplished just prior to initial target impact or following penetration of some predetermined number of target layers and so on. Generally therefore the invention is considered to involve segregation of the bomb casing and charge into segments at some location reached after launch of the weapon from an aircraft or by other means.

The layers of material located above and below the canister 59 in the layers 60 and 61 provide isolation of the separators-attenuators including the conical cutter from the warhead charges and precludes warhead charge premature detonation from detonation of the cutter charge 64 and also from target impact. Preferably the layers 60 and 61 are made from steel, such as the above identified 4340M steel, and from the a non explosive shock wave attenuating material such as polymethylmethacralate respectively.

SPALL MECHANISM CUTTER

Figure 6A:
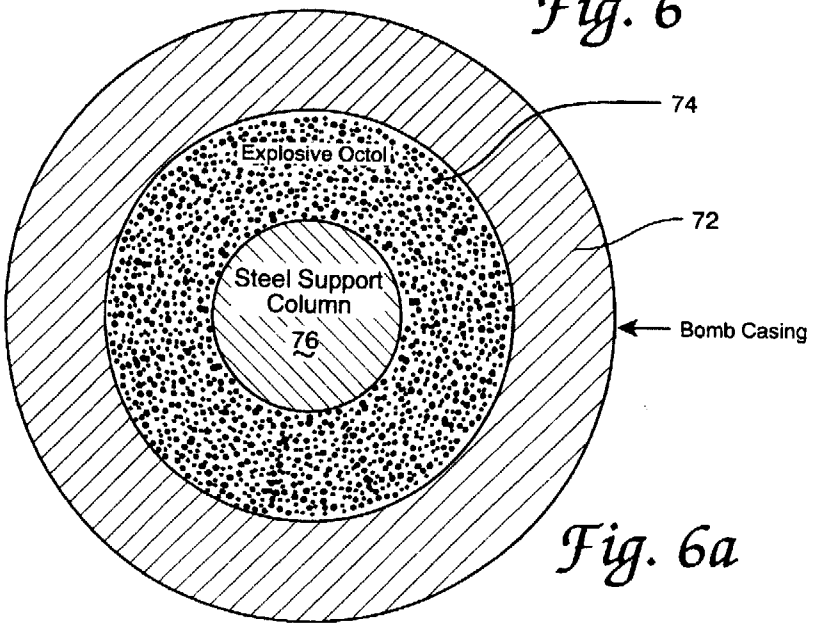

The spall mechanism cutter shown in FIGS. 6 & 6*a* is also capable of cutting the FIG. 1 and FIG. 2 penetrator bomb into lengthwise portions or segments by placing an explosive charge in direct contact with the penetrator bomb wall and using the detonation pressure of this explosive charge to spall the steel of the wall, thereby effectively separating the case through an arc of 360 degrees. FIGS. 6 and 6*a* show two views of an annular or doughnut-shaped cutter charge 74 inside a penetrator bomb casing 72. Explosives that may be used at 74 are the above described "PBXN-110" and "Octol". The explosive charge that is used to spall the penetrator bomb is initiated through an aperture 80 that is located in a steel support block 84*a*. The aperture 80 receives explosive communication linkage from a not shown explosive lead receivable via the aperture 80 to ignite the spall charge. The spall charge mass 74 may have a weight in the range of one hundred fifty (150) grams in the instance of a penetrator bomb of the FIG. 6 and FIG. 6*a* physical size.

The FIG. 6 and FIG. 6*a* steel support blocks 84*a* and 84*b* are also provided with crush preventing mechanical support by the centrally disposed steel support column 76 for transferring impact and detonation loads. FIG. 7 in the drawings represents a view from a photograph, of one section of a penetrator bomb which has been cut in half using a spallation cutter charge with "Octol" as the explosive. Longitudinal fracturing of the penetrator bomb casing is an area of concern in the use of a spallation cutter arrangement; steps to prevent this type of fracture are believed necessary in a successful spallation cutter configuration in view of the effects of hoop stress, micro cracking, and the tendency of strain energy to focus in microcracks and produce longitudinal splintering of the casing.

In FIGS. 6 and 6*a*, the penetrator bomb is represented by a steel casewall 72 which may have an inner diameter of five inches, and a wall thickness of one inch. At the center of this FIG. 6 and FIG. 6*a* structure there is located the steel support column 76 which is typically 0.5 inch high, with the explosive charge 74 being disposed between it and the wall 72. Above and below the support column 76 are the steel support blocks 84*a* and 84*b*, each of which is shown as being one inch in thickness. Above and below the support blocks 84*a* and 84*b* i.e., at the top and bottom of the FIG. 6 structure and inside the casing 72 are disposed layers of shock attenuation material 82*a* and 82*b*.

BOMB/TARGET INTERACTION DESCRIPTION

Figure 2A:
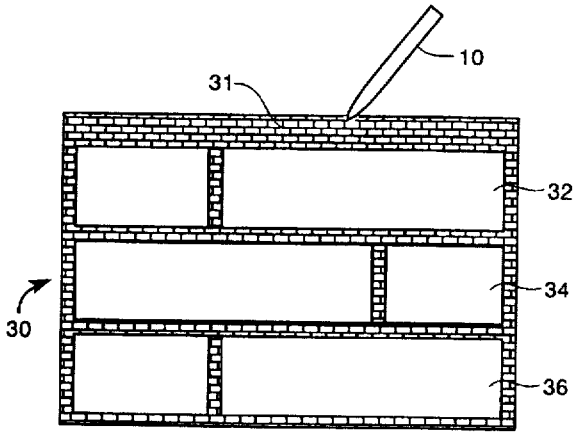
Figure 2B:
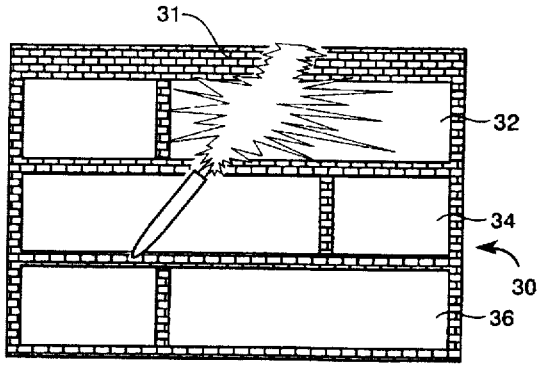
Figure 2C:
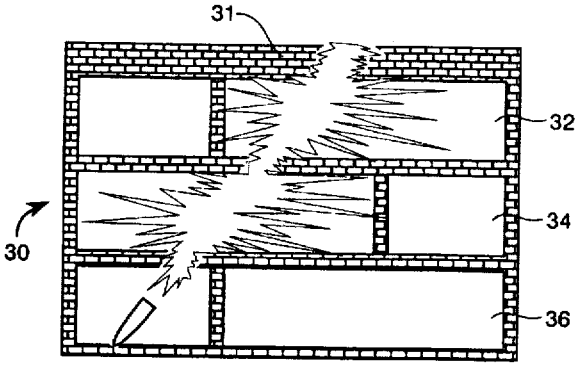
Figure 2D:
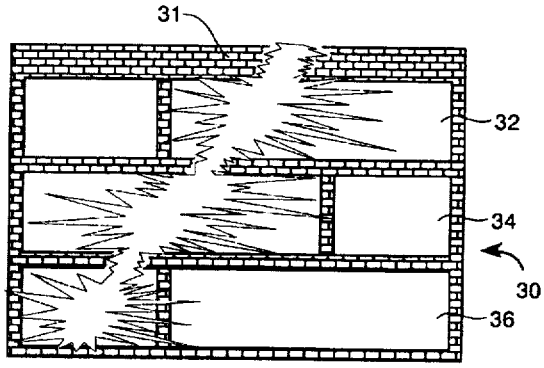

FIGS. 2*a* through 2*d* show a target 30 being impacted by the multi-segment hard target penetrator bomb 10. In FIG. 2*a*, target impact at the upper surface 31 activates a time delay fuze in target penetrator bomb 10. In FIG. 2*b*, the aft segment detonates destroying the first layer 32 of the target and damaging the second layer 34. In FIG. 2*c*, the mid segment detonates destroying the second layer 34 of the target and damaging the third layer 36. In FIG. 2*d*, the nose segment detonates destroying the third layer 36 of the target 30. Each of these three FIG. 2 warhead detonations is of course preceded by a penetrator bomb cutting event through the action of a FIG. 4 through FIG. 7*a*, & 7*b* cutter.

One alternative arrangement for munition according to the invention may employ discrete fuzing systems in each of the penetrator bomb segments. This alternative is most viable for a two segment penetrator bomb 40 as shown in FIG. 3, a penetrator bomb with one fuze 44 located in the nose section and another fuze 46 in the aft end. Such fuzes could be easily accessed by arming wires or lanyards that insure the fuzes are intentionally misaligned physically (a fuzing practice known in the art and used in the interest of non detonation safety) when carried on an aircraft. The FIG. 3 penetrator bomb is shown to incorporate a single separator assembly 20 which may incorporate some portion of the cutter apparatus described in connection with FIG. 4 through FIG. 7*b* above; the different representation of the separator assembly 20 in FIG. 3 is intended to indicate that alternative cutter arrangements may be used in differing embodiments of the invention.

Another alternative arrangement of the invention may involve packaging each segment of the penetrator bomb in a separate shell, a shell that can be inserted as a unit in the steel cylinder of the casing. In this application, the number of segments can be varied depending upon the target of interest.

CONCLUSION

The Multi-Segment Hard Target Penetrator bomb (MSHTP) of the present invention presents weapon designers with a unique way of increasing the lethality of a hard target penetrator bomb device.

It is understood that certain modifications to the invention as described may be made, as might occur to one with skill in the field of the invention, within the scope of the appended claims. Therefore, all embodiments contemplated hereunder which achieve the objects of the present invention have not been shown in complete detail. Other embodiments may be developed without departing from the scope of the appended claims.

What is claimed is:

1. Multiple explosive charge sequential detonation multiple layered hardened target penetration warhead weapon apparatus comprising the combination of:

a unitary one-piece body member having an axially aligned uppermost nose end and subtending lengthwise and downward extending integral elongated hollow thick-walled metal cylinder body portion;

a first warhead charge of low mechanical shock-sensitivity first explosive material received within said subtending lengthwise extending integral elongated hollow metal cylinder body portion;

a second warhead charge of low mechanical shock-sensitivity second explosive material received axially adjacent said first warhead charge within said subtending lengthwise extending integral elongated hollow metal cylinder body portion;

separator means disposed in selected axial location within said subtending elongated metal cylinder hollow body portion and segregating said first and second warhead charges of explosive material into axially separate individually controllable discrete segments;

said separator means including third explosive material charged metal jet-generating cutter means for electively separating said body member integral elongated metal cylinder body portion and said first and second low mechanical shock-sensitivity explosive material charges into lengthwise separated warhead segments subsequent to a warhead ballistic launching event;

said separator means third explosive material charge metal jet generating cutter means comprising an explosive material mass of overall hourglass shape with an upstanding central cylindrical portion that is topped and bottomed by mating diameter conical frustum portions of increasing diameter in respective upward and downward directions, and a similarly shaped laterally-enclosing fusible metallic copper jacket surrounding said explosive material mass;

a closed rigid metallic cylinder canister member surrounding both lateral and end portions of said third explosive material charge and said similarly shaped laterally-enclosing metallic copper jacket, said rigid metallic cylinder canister member being received within said separator means and within said unitary body member for shunting externally sourced deformation forces around said third explosive material charge and said similarly shaped laterally-enclosing fusible metallic copper jacket;

a first explosion force containment member comprising a first metallic disk member in contact with one end portion of said closed rigid metallic cylindrical canister member and a first energy absorbing disk member in contact with said first metallic disk member;

a second explosion force containment member comprising a second metallic disk member in contact with an opposite end portion of said closed rigid metallic cylindrical canister member and a second energy absorbing disk member in contact with said second metallic disk member; and an explosive material igniter fuze member centrally located within said third explosive material mass.

2. The warhead weapon apparatus of claim 1 wherein said third explosive material charge metal jet generating means conical frustum portions of increasing diameter in respective upward and downward directions include explosive material having conical frustum surfaces disposed at an angle of thirty five degrees plus or minus five degrees with respect to a horizontal reference member.

3. The warhead weapon apparatus of claim 1 wherein said third explosive material charge has a weight between four hundred forty and four hundred sixty grams.

4. The warhead weapon apparatus of claim 1 wherein said third explosive material charge is comprised of a material selected from the group consisting of "PBXN-110" and "Octol" explosives.

5. The warhead weapon apparatus of claim 1 wherein said warhead charges are three in number and said separator means are two in number.

6. The warhead weapon apparatus of claim 1 wherein said hardened target penetration warhead weapon apparatus is an aircraft-carried aerial bomb.

7. The warhead weapon apparatus of claim 1 wherein said thick-walled metal cylinder body portion has a wall thickness of one inch.

8. The warhead weapon apparatus of claim 1 wherein said first and second warhead charges of low mechanical shock-sensitivity explosive material comprise thirty percent TNT, forty percent NTO, twenty percent Aluminum and ten percent wax.

9. The warhead weapon apparatus of claim 1 wherein said first and second warhead charge of low mechanical shock-sensitivity second explosive material further include pyrotechnic detonator delay elements and booster explosive materials.

10. The warhead weapon apparatus of claim 1 further including separate and discrete fuzing systems in each warhead charge of explosive material.

11. The warhead weapon apparatus of claim 1 further including means for electively separating said body member integral elongated metal cylinder and said first and second low mechanical shock-sensitivity explosive material charges into lengthwise separated warhead segments in response to a target impact event.

12. Radially acting liquefied metal jet explosive cutter apparatus for separating an elongated cylindrical member into axially segregated cylindrical segments, said apparatus comprising the combination of:

an explosive material mass of overall hourglass shape disposed along a central axis of said elongated cylindrical member and having an axially disposed small diameter central cylindrical portion terminating at both ends in axially extending conical frustum portions of increasing radial diameter along said central axis of said elongated cylindrical member;

a conformal enclosure member disposed surrounding lateral surface portions of said explosive material and having a mating hourglass shape which includes an axially disposed small diameter central cylindrical portion terminating at both ends in axially extending conical frustum portions of increasing radial diameter along said central axis of said elongated cylindrical member;

said conformal enclosure member being composed of a explosive detonation temperature and pressure-liquefiable metal material;

a closed rigid metallic cylindrical canister member receivable along said central axis within said elongated cylindrical member and disposed surrounding both lateral and end portions of said explosive material mass and said enclosure member;

a first explosion force containment member comprising a first metallic disk member in contact with one end portion of said closed rigid metallic cylindrical canister member and a first energy absorbing disk member in contact with said first metallic disk member;

a second explosion force containment member comprising a second metallic disk member in contact with an opposite end portion of said closed rigid metallic cylindrical canister member and a second energy absorbing member in contact with said second metallic disk member; and an explosive material igniter fuze member centrally located within said axially disposed central cylindrical portion of said explosive material mass.

13. The liquefied metal jet explosive apparatus of claim 12 wherein said explosive material mass hourglass shape increasing radial diameter conical frustum portion defines an angle of thirty five degrees plus and minus five degrees with respect to a radial from said central axis.

14. The liquefied metal jet explosive apparatus of claim 12 wherein said explosive detonation temperature and pressure-liquefiable metal material comprises metallic copper.

15. The liquefied metal jet explosive apparatus of claim 12 wherein said explosive material is comprised of one of the materials of Octol and PBXN-110 and has a weight of four hundred forty to four hundred sixty grams.

16. The liquefied metal jet explosive apparatus of claim 15 wherein said explosive material and said conformal enclosure member each have a length of three and one tenth inches, and a diameter of five inches at a conical frustum axial extremity; and with said dimensions being multiplied by a scaling factor of numeric value between one-half and two.

* * * * *